US005894034A

United States Patent [19]

Andersson et al.

[11] Patent Number: 5,894,034

[45] Date of Patent: Apr. 13, 1999

[54] METHOD OF MAKING METAL COMPOSITE POWDER

[75] Inventors: Sara Andersson, Solna; Muhammed Mamoun, Djursholm, both of Sweden

[73] Assignee: Sandvik AB, Sandviken, Sweden

[21] Appl. No.: 08/928,669

[22] Filed: Sep. 12, 1997

Related U.S. Application Data

[63] Continuation of application No. 08/718,701, Sep. 27, 1996, abandoned.

[30] Foreign Application Priority Data

Sep. 29, 1995 [SE] Sweden ..... 9503420

[51] Int. Cl.[6] ..... B05D 3/10

[52] U.S. Cl. ..... 427/217; 427/383.3; 427/443.1; 419/18; 419/35

[58] Field of Search ..... 427/217, 226, 427/443.1, 383.3; 419/10, 14, 18, 35

[56] References Cited

U.S. PATENT DOCUMENTS

| | | | |
|---|---|---|---|
| 4,268,536 | 5/1981 | Beckenbaugh et al. | 42/54.1 |
| 4,539,041 | 9/1985 | Figlarz et al. | 75/0.5 A |
| 4,770,907 | 9/1988 | Kimura | 427/217 |
| 5,529,804 | 6/1996 | Bonneau et al. | 427/217 |

FOREIGN PATENT DOCUMENTS

| | | |
|---|---|---|
| 0113281 A1 | 7/1984 | European Pat. Off. . |
| 345473 | 5/1931 | United Kingdom . |
| 9526843 A1 | 10/1995 | WIPO . |

OTHER PUBLICATIONS

Pi et al, PAC, RIM Int. Conf. Adv. Mater. Process, Proc. Meet., 1st (1993), pp. 199–201.

*Primary Examiner*—Erma Cameron
*Attorney, Agent, or Firm*—Burns, Doane, Swecker & Mathis, L.L.P.

[57] ABSTRACT

A method of making a hard constituent powder coated with Co and/or Ni in a solution by liquid reduction of the Co and/or Ni from a suitable metal compound with a polyol while keeping the powder in suspension, the polyol functioning both as a solvent and as a reducing agent at the same time. By separating the intermediate solid compound and hard constituent from the suspension before any by-products are formed and reducing the intermediate solid compound in the dry state by $H_2$ for around 24 hours or by using an excess of about 10 times more moles polyol than moles metal, the polyol can be conserved or reused leading to improved cost efficiency of the process.

13 Claims, No Drawings

METHOD OF MAKING METAL COMPOSITE POWDER

This application is a continuation, of application Ser. No. 08/718,701, filed Sep. 27, 1996 now abandoned.

FIELD OF THE INVENTION

The present invention relates to a method of producing metal composite powder such as for example cemented carbide.

BACKGROUND OF THE INVENTION

U.S. Pat. No. 5,529,804, the disclosure of which is hereby incorporated by reference, discloses a method of coating hard constituent powders with Co and/or Ni with the polyol process disclosed in U.S. Pat. No. 4,539,041 and used today for the manufacture of cobalt and nickel metal powders with a small particle size. According to U.S. Pat. No. 5,529,804, hard constituent powder in suspension in a polyol solution containing an oxide, hydroxide or salt of Co and/or Ni during reduction of cobalt and nickel by the polyol obtains a cobalt and/or nickel metal precipitation on the surface. The metals are precipitated with a quite even distribution over the surface of the carbides without forming separate islands. However, the requirement of a large excess of ethylene glycol and the technical difficulties in separating and removing the ethylene glycol oxidation by-products interfere with the economy of the process. Further, a mixture of by-products are formed during the reduction which complicates separation of un-reacted ethylene glycol. A suitable strategy to improve the process economy is to recycle or decrease an excess amount of ethylene glycol needed for the cobalt or nickel reduction.

SUMMARY OF THE INVENTION

It is an object of this invention to avoid or alleviate disadvantages and/or problems of the prior art.

It is a further object of the present invention to improve the cost efficiency of the process for coating hard constituent powders with cobalt or nickel metal using the polyol process disclosed in U.S. Pat. No. 5,529,804.

According to the invention, a metal composite powder is made by a process in which consumption of polyol is reduced. In the process, a hard constituent powder is coated with metal comprising Co and/or Ni, the coating being carried out by reacting a solution containing a compound of the metal with a polyol while keeping the hard constituent powder in suspension, the polyol simultaneously functioning as a solvent and as a reducing agent and the polyol being present in excess relative to a stoichiometric amount of polyol to metal sufficient to form an intermediate solid compound containing $Co^{2+}$ and/or $Ni^{2+}$ on the hard constituent powder, the method comprising interrupting the reaction and separating an intermediate solid compound and the hard constituent powder from the suspension before any oxidation by-products are formed in the solution followed by a heat treatment which reduces the intermediate solid compound to a metal coating on the hard constituent powder or using an excess of polyol of less than five times the stoichiometric amount.

DETAILED DESCRIPTION OF THE PREFERRED EMBODIMENTS

The invention provides a method for improving cost efficiency of a process for coating hard constituent powders with cobalt or nickel using a polyol process as disclosed in U.S. Pat. No. 5,529,804. The efficiency can be improved by reducing the consumption of ethylene glycol such as by incorporating a heat treatment in the process or by recycling ethylene glycol at a stage of the process at which oxidation by-products do not interfere with the desired reaction.

In a first embodiment of the present invention, the consumption of ethylene glycol is economized by interrupting the reaction before any oxidation by-products are formed in the solution and completing the metal reduction by heat treatment in the dry state. A complete reduction of the $Co^{2+}$ in the intermediate phase on WC can be accomplished by reduction in $H_2$ at 550° C. for 24 hours. In this way, only a stoichiometric amount of the ethylene glycol is consumed and the excess of ethylene glycol is prevented from being polluted with the oxidation by-products that are formed when $Co^{2+}$ is reduced in solution. The ethylene glycol can thus be re-used several times without purification.

In a second embodiment, the ethylene glycol that has been used for reducing one batch of $Co(OH)_2$ to cobalt metal on WC is re-used in an identical cobalt reduction. If an excess of about 10 times of ethylene glycol is used there is sufficient un-reacted ethylene glycol left in the reaction mixture to reduce an additional amount of $Co(OH)_2$. It has been found that the by-products present do not interfere with the reaction. Re-using ethylene glycol in a reaction period of one hour is more efficient than re-using it in a five hour reduction period. The cobalt in the powders is reduced by $H_2$ in the dry state.

In a third embodiment, the excess of ethylene glycol is reduced by a factor of two and more. Normally an excess of 10 times the stoichiometric amount of cobalt is used to achieve adequate stirring of the highly viscous suspension. Preferably, the excess is reduced to 5 times and even to 3 times the stoichiometric amount. In this case, the stirring of the suspension becomes less effective since the mixture becomes highly viscous. However, the stirring has been found to be sufficient to give a rather even distribution of the precipitated cobalt metal on the WC surface. By using an excess of 3–4 times of the ethylene glycol, complete reduction of the cobalt is still achieved but the distribution of the cobalt metal on the WC surface is less even compared to when a larger excess is used. Decrease of the ethylene glycol excess is more easily accomplished when WC is kept in suspension compared to when (Ti,W)C is kept in suspension where an excess of no less than 5 times should be used. In the case of nickel, the reduction is generally faster, the yield is higher and the reduction seems to require a smaller excess of ethylene glycol.

Preferably, the process economy is optimized by a combination of separation of the intermediate solid compound and WC from the ethylene glycol mixture after 15–60 minutes of reaction and reduction of the intermediate solid compound in the dry state by $H_2$ at 550° C. for around 24 hours combined with re-use of the ethylene glycol. This would best be accomplished in a crosscurrent mode.

In an alternative method, colloidal $Co(OH)_2$ is precipitated from an aqueous solution of $Co(CH_3COO)_2 \cdot 4H_2O$ by addition of $NH_3$ or a hydroxide. A precipitate is formed on the WC surface which is separated from the solution and reduced by heat treatment in the dry state.

The invention has been described with reference to WC and Co but can also be applied to Ni, (W,Ti)C and other hard constituents.

The invention is additionally illustrated in connection with the following Examples which are to be considered as illustrative of the present invention. It should be understood, however, that the invention is not limited to the specific details of the Examples.

EXAMPLE 1

94 g WC was suspended in 120 ml of ethylene glycol in a 500 ml stirred glass reactor equipped with a thermometer and an air-cooled condenser for the removal of volatile by-products while most of the ethylene glycol was recycled. 10.07 g $Co(OH)_2$ was added while stirring. The excess of ethylene glycol was 10 times the stoichiometric amount. The amount of dry substance was 44 weight %. The suspension was heated above 180° C. and was kept at this temperature for the given reaction time. The solid phase was then separated from the ethylene glycol by centrifugation, washed with ethanol and dried overnight at 40° C.

The product mixtures obtained after the investigated reaction times of 30, 45, 60, 75, 90 and 120 minutes consisted in all cases of two partially mixed solid phases. One grey phase of WC and one phase that varied in color with the reaction time from pink after 30 minutes of reaction to purple after one hour and then back to pink after 75 minutes of reaction and finally the phase turned brown or reddish-brown after 120 minutes of reaction. The residual ethylene glycol phase was in all cases turbid. After several days of sedimentation, the ethylene glycol became clear with a gelatinous brown phase at the bottom.

The color of the ethylene glycol had turned yellow after 30 minutes of reaction and yellow-brown after 45 minutes of reaction. After 75 minutes the residual ethylene glycol had obtained a dark brown color.

Two different phases could be distinguished in SEM-microscopy. The phases were mixed to some extent but there were also particles of around 10 μm present consisting of a phase different from WC and cobalt metal.

The X-ray powder diffraction showed that the strongest peak of the intermediate complex of $Co^{2+}$ and ethylene glycol could be detected in all samples. After 90 minutes of reaction the strongest peak from cobalt metal starts to become distinguishable.

The yield of cobalt in the samples varied between 80 and 94%.

EXAMPLE 2

The sample reduced during one hour was used for further experiments where the solid phase was reduced by heat treatment in the dry state. The samples used for the reduction by heat treatment in the dry state were reduced in ethylene glycol for one hour before separation and consisted of two partially mixed solid phases: one grey WC phase and one pink $Co^{2+}$-ethylene glycol complex phase.

After reduction under $H_2$ atmosphere at 550° C. for 24 hours the sample appeared homogeneously grey in color. SEM-examination showed that there were spherical, presumably cobalt metal particles present as well as particles around 10 μm consisting of a phase other than WC and similar to the particles present before the reduction.

In the X-ray powder diffraction spectrum only WC and cobalt metal (cubic) were detected.

EXAMPLE 3

28.2 g of WC was suspended in 35 ml of ethylene glycol that had already been used in one identical reduction using the same apparatus as in Example 1. 2.97 g $Co(OH)_2$ was added while stirring. The excess of ethylene glycol was 10 times the stoichiometric amount and the amount of dry substance was 44 weight %. The suspension was heated with adequate stirring and allowed to boil for five hours and one hour, respectively. The solid phase was then separated from the ethylene glycol by centrifugation, washed with ethanol and dried at 40° C. overnight.

The sample obtained after re-using an ethylene glycol mixture from a five hour reduction in an additional reduction of the same amount of $Co(OH)_2$ for 5 hours consisted of two partially mixed phases: one grey WC phase and one white-pink phase. In the SEM, two different phases could be distinguished that were partially mixed but a phase other than WC also formed separate islands of >10 μm. The X-ray powder diffraction spectrum showed no cobalt metal present. Only peaks from WC and from unidentified phases were found.

The sample obtained after re-using an ethylene glycol mixture from a one hour reduction to reduce the same amount of $Co(OH)_2$ again for one hour also consisted of two partially mixed phases: one grey WC phase and one pink phase. In the SEM, the sample looked the same as the sample obtained after one hour of reduction in fresh ethylene glycol. In the X-ray powder diffraction spectrum, no other peaks than those for WC could be detected. The total yield of cobalt in these two samples was around 87%.

EXAMPLE 4

18.8 g WC was suspended in 11.5 ml ethylene glycol in a 250 ml stirred glass reactor using the same apparatus as in Example 1. 2.02 g $Co(OH)_2$ was added while stirring and the suspension was heated until boiling. The excess of ethylene glycol was 5 times the stoichiometric amount and the amount of dry substance was 62 weight %. The reaction mixture was allowed to boil for 5 hours and the solid phase was then separated from the ethylene glycol by centrifugation, washed in ethanol and dried at 40° C. overnight.

The same reaction procedures were then repeated but with the excess of ethylene glycol reduced further to 9 ml corresponding to an excess of between 3 and 4 times the stoichiometric amount (some ethylene glycol was lost during the distillation) and the amount of dry substance was 68 weight %.

In both experiments, using 5 and 3–4 times excess of ethylene glycol for five hours of reaction, the samples appeared to be homogeneously grey. SEM-studies showed that there were spherical cobalt metal particles present on the WC surface and no other separate phase present. The spherical particles appeared to be somewhat more evenly distributed on the WC surface when an excess of 5 times of ethylene glycol was used as compared to when an excess of 3–4 times was used.

In the X-ray powder diffraction spectra, only peaks from cobalt metal and WC could be detected in both samples. The yield of cobalt metal seemed to decrease when the excess of ethylene glycol was decreased and was 85% in these experiments as compared to 94% when 10 times excess of ethylene glycol was used.

EXAMPLE 5

26.7 g of (W,Ti)C was suspended in 35 ml of ethylene glycol that had already been used in one identical reduction, (the ethylene glycol contained a small amount of $H_2SO_4$ to increase the solubility of $Ni(OH)_2$. The excess of ethylene glycol was 5 times the stoichiometric amount and the amount of dry substance was 44 weight %. 5.69 g $Ni(OH)_2$ was added while stirring. The suspension was heated with adequate stirring and allowed to boil for 5 hours. The solid phase was then separated from the ethylene glycol by centrifugation, washed with ethanol and dried at 40° C. overnight.

The precipitate was homogeneously grey in color. The SEM micrographs showed an even distribution of spherical particles with a particle size of around 1 μm on the (W,Ti)C surface. In the X-ray powder diffraction spectrum, no other peaks than those of nickel metal and (W,Ti)C could be detected. The yield of nickel was 99%.

EXAMPLE 6

13.489 g $Co(CH_3COO)_2 \cdot 4H_2O$ was dissolved in 50 ml water by heating. 47 g WC was suspended and a solution of 4.07 g NaOH (stoichiometric amount) dissolved in 10 ml water was added drop-wise during five minutes while stirring. The reaction mixture was stirred for another 20 minutes and the solid phase was then separated from the water by filtration, washed with water and dried at 40° C. overnight.

The sample appeared to be homogeneously dark in color with a quite even distribution of an amorphous phase on the surface of WC. In the X-ray powder diffraction spectrum, only the peaks from WC and $Co(OH)_2$ could be observed. The yield of cobalt was 87%.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A method of coating a powder selected from carbides, nitrides and/or carbonitrides with metal comprising Co and/or Ni, the coating being carried out during reaction of a solution containing a compound of the metal with a polyol while keeping the powder in a suspension including the solution, the polyol simultaneously functioning as a solvent and as a reducing agent and the polyol being present in excess relative to a stoichiometric amount of polyol to metal which forms an intermediate solid compound containing $Co^{2+}$ and/or $Ni^{2+}$ on the powder, the method comprising interrupting the reaction and separating an intermediate solid compound and the powder from the suspension before any oxidation by-products are formed in the solution followed by heat treating the intermediate solid compound so as to reduce the intermediate solid compound and provide a coating of the metal on the powder.

2. The method of claim 1, wherein the polyol comprises ethylene glycol.

3. The method of claim 1, wherein the metal comprises cobalt and the powder comprises WC.

4. The method of claim 1, wherein the intermediate solid compound comprises $Co(OH)_2$ or $Ni(OH)_2$ or mixture thereof.

5. The method of claim 1, wherein the reaction is carried out for less than six hours.

6. The method of claim 1, wherein the intermediate solid compound is precipitated from the solution by addition of $NH_3$ or a hydroxide.

7. The method of claim 1, wherein the metal compound comprises a metal salt.

8. The method of claim 1, wherein the heat treatment is carried out in a hydrogen atmosphere.

9. The method of claim 1, wherein the heat treatment is carried out at a temperature of at least 300° C. for at least one hour.

10. The method of claim 1, wherein the heat treatment is carried out at a temperature of less than 100° C. for at least eight hours.

11. The method of claim 1, wherein the polyol separated from the suspension is reused by repeating the process with a different batch of powder.

12. The method of claim 1, wherein the excess of polyol is about 10 times the stoichiometric amount.

13. The method of claim 1, wherein the powder comprises (Ti,W)C and the excess of polyol is at least five times the stoichiometric amount.

* * * * *